US006111210A

United States Patent [19]

Allison

[11] Patent Number: 6,111,210

[45] Date of Patent: Aug. 29, 2000

[54] ELECTRICAL SAFETY OUTLET

[76] Inventor: John B. Allison, 34147 N. Evergreen St., Chandler, Ariz. 85224

[21] Appl. No.: 09/364,642

[22] Filed: Jul. 30, 1999

[51] Int. Cl.[7] ..... H01R 33/96

[52] U.S. Cl. ..... 200/51.09

[58] Field of Search ..... 200/51.09

[56] References Cited

U.S. PATENT DOCUMENTS

| | | |
|---|---|---|
| 2,540,496 | 2/1951 | Sperrazza . |
| 2,751,567 | 6/1956 | Bissell et al. . |
| 3,699,285 | 10/1972 | Leatherman . |
| 3,755,635 | 8/1973 | McGill . |
| 5,095,182 | 3/1992 | Thompson . |
| 5,347,095 | 9/1994 | Zeder . |
| 5,513,999 | 5/1996 | Fry et al. . |

*Primary Examiner*—Michael L. Gellner
*Assistant Examiner*—Nhung Nguyen
*Attorney, Agent, or Firm*—Carter & Schnedler

[57] ABSTRACT

An electrical safety outlet is provided and consists of a plug receptacle having typically at least a large neutral blade-slot and a small voltage blade-slot for receiving a large neutral blade and a small voltage blade of a corresponding and mating multi-prong polarized plug. The invention also applies to older plugs and three-blade plugs where both the neutral and voltage blades are the same width. In one embodiment, insertion of the multi-prong polarized plug depresses the exterior lobes of two separate cams which work together to change the normally open circuit receptacle of the present invention to a closed circuit receptacle. In order for both cams to be activated, the mating multi-prong polarized plug must be inserted almost completely into the plug receptacle before the electrical circuit is closed, thereby supplying current to the plug. The neutral prong must be at least the width of the voltage prong to close the circuit.

1 Claim, 9 Drawing Sheets

ELECTRICAL SAFETY OUTLET

BACKGROUND OF THE INVENTION

1. Field of the Invention

This invention relates generally to electrical outlets, and more specifically to an improved safety feature to protect against injury caused by metal objects other than plugs being inserted into the openings of the electrical outlets.

2. Description of the Related Art

Electrical outlets have become standardized to the two-prong or three-prong configurations. The exposed face of these outlets have narrow openings that prevent even small children's fingers from coming in contact with dangerous electrical current. However, children sometimes do insert small metal objects, such as bobby pins and paper clips into the narrow openings of electrical outlets, occasionally with disastrous results.

A similar hazard is found in a partially inserted plug when used with the commonly used electrical outlet. Children's fingers, and even adult's fingers, can get across the prongs of a partially inserted plug, resulting in an electrical shock and/or burn. If the person has another part of his body in contact with an electrical ground, a serious injury or fatality could result.

It is known to provide a safety feature in electrical outlets to prevent electrical shock and injury. For example, U.S. Pat. No. 2,540,496 to J. J. Sperrazza, issued Feb. 6, 1951, discloses an electrical outlet having a non-conducting cam block located about half way down the length of each plug prong slot that forces together the contact points for the opposite side of the receptacle when a plug prong is inserted about half way into the electrical outlet. The outlet is thus made electrically hot while at least one half of the prongs of the plug being inserted are still exposed to contact by the person inserting the plug. This is required to prevent electrical arcing in the electrical outlet. Furthermore, the disclosure provides that inserting a plug into one outlet of a multi-outlet receptacle makes both outlets electrically hot even though one is not in use.

In U.S. Pat. No. 2,751,567 to C. H. Bissell et al, issued Jun. 19, 1956, is disclosed an explosion proof electrical connector system requiring a specialized electrical outlet and a specialized mating electrical plug. There is no teaching of how to utilized this invention with a conventional residential or commercial electrical outlet commonly used for lamps, small appliances, office equipment, and small power tools.

Another method of providing safety measures to the common electrical duplex outlet is disclosed in U.S. Pat. No. 3,669,285 to Leatherman, issued Oct. 17, 1972. The disclosure teaches using a specialized form of the ground prong on a three-prong plug to make the outlet electrically hot. The teaching will not work with the common polarized two-prong plug at all, and will only work with a three-prong plug have a special configuration. In addition, there is no teaching of how to prevent both outlets from becoming electrically hot when only one outlet has a plug inserted into it. Another teaching of using the ground prong of a three-prong plug to activate the outlet is disclosed in U.S. Pat. No. 3,755,635 to McGill, issued Aug. 28, 1973. In this teaching the ground prong activates a low-current microswitch, which in turn activates a relay allowing electrical current to flow to the plug. While not disclosed, the relay apparently is large enough to cause a standard duplex outlet to contain only one plug outlet. Again there is no teaching of how to use a polarized two-prong plug with this invention. In fact such a plug, common on most small appliances, will not work with this invention.

A safety duplex outlet for a polarized two-prong and three-prong plug is disclosed in U.S. Pat. No. 5,095,182 to Thompson, issued Mar. 10, 1992. This disclosure teaches the use of a microswitch mounted behind the large slot of a standard polarized wall outlet. However, a person inserting a wire, paper clip, or the like, of any width that fits within the outlet slots, into both slots could activate the microswitch located at the bottom of the slot and thereby circumvent the safety feature. In addition, the addition of microswitches mounted on the bottom of the outlet would prevent the mounting of the outlet in standard electrical boxes.

In U.S. Pat. No. 5,347,095 to Zeder, issued Sep. 13, 1994, is disclosed an electrical outlet which gives an audible warning when an electrical plug is removed from it. There is no teaching of how to provide an electrically safe outlet.

U.S. Pat. No. 5,513,999 to Fry et al, issued May 7, 1996, discloses a manner of activating an outlet/plug assembly upon partial insertion of the plug into the outlet. However, the outlet and plug are non-standard designs, which would require the replacement of both the common standard duplex outlet, and the commonly provided polarized two-prong and three-prong plugs.

Thus, there continues to be a need for an electrical outlet having an enhanced safety feature to protect against injury caused by inserting conductive objects, other than electrical plugs, into the outlet openings.

OBJECTS OF THE INVENTION

One object of this invention is to provide an electrical outlet with enhanced safety features to protect against injury caused by metal objects other than electrical plugs being inserted into the electrical outlet openings.

Another object of this invention is to provide an electrical outlet having enhanced safety features, which does not require special electrical plugs or non-standard outlet boxes or wiring to provide the enhanced safety features.

Yet another object of the invention is to provide an enhanced safety feature electrical outlet which will be readily accepted by the users and installers of such electrical outlets.

SUMMARY OF THE INVENTION

Accordingly, one form of the present invention relates to an electrical safety outlet comprising: an electrical outlet plug receptacle of the type having a front mating face molding and having a neutral blade contact slot and a voltage blade contact slot opening to said front mating face thereof and receiving, in a mating direction, a neutral blade and a voltage blade, respectively, of a corresponding mating plug; a normally opened switch of the spring type, electrically connected to the voltage blade contact slot; a spring/cam assembly; a linking arm; a non-conductive lever; said switch being activated by said spring/cam assembly, said linking arm and said non-conductive lever; said spring/cam assembly being physically located within said neutral blade slot and having an extension outside the plane of said neutral blade slot; said linking arm attached to said non-conductive lever, thereby actuating said spring type switch, whereby said mating plug is inserted into said receptacle; the spring/cam assembly is pressed aside, moving said non-conductive lever by means of said linking arm into the path of said neutral blade of said plug which upon full insertion depresses said nonconductive lever, closing said spring type switch assembly and thereby, activating said outlet plug receptacle to supply current to said multi-prong plug.

Another form of the present invention relates to an electrical safety outlet comprising: an electrical outlet plug receptacle of the type having a front mating face molding and a back molding and having a neutral blade contact slot and a voltage blade contact slot opening to said front mating face thereof and receiving, in a mating direction, a neutral blade and a voltage blade, respectively, of a corresponding mating plug; a normally opened switch assembly of the spring type, electrically connected to the voltage blade contact slot and being activated by a non-conductive hinged arm; a first cam of non-conductive composition, having an exterior lobe and an interior lobe, connected into the neutral blade slot and being activated when a mating neutral prong of a multi-prong plug is inserted into the plug receptacle, the neutral blade of the plug entering the neutral blade slot will depress the first cam exterior lobe thereby moving said interior lobe and bending a non-conducting hinged arm; a hinged arm of non-conducting composition having two ends, one end connected to said first cam interior lobe and the other end connected to said normally opened switch assembly; a second cam of non-conducting composition, having an exterior lobe and an interior lobe, connected into the neutral blade slot and being activated when a mating neutral prong of a multi-prong plug is inserted into the neutral blade slot, after said mating neutral prong of said multi-prong plug has depressed said exterior lobe of said first cam, thereby forcing the interior lobe of said second cam against said hinged arm, straightening said hinged arm and thereby forcing said hinged arm against said normally open switch assembly, closing said switch assembly and thereby activating said electrical outlet plug receptacle to supply current into said multi-prong plug.

Yet another form of this invention relates to an electrical safety outlet comprising: an electrical outlet plug receptacle having a front mating face, a neutral blade contact slot and a voltage blade contact slot opening to the front mating face thereof and receiving, in a mating direction, a neutral blade and a voltage blade, respectively, of a corresponding mating plug; a normally opened switch electrically connected to the voltage blade contact slot; a device for enabling the activation of the switch received within the receptacle and responsive to one of the blades, being in a first position within its respective blade contact slot; a device for activating the switch received within the receptacle; the device for activating the switch being responsive to the device for enabling the activation of the switch and to one of the blades being in a second position within its respective blade contact slot, whereby voltage is applied to the voltage contact upon the closure of the switch.

The method used by the device of this invention is to sense the width of the neutral contact or foreign object inserted into the outlet. If the prong or foreign object is less than a predetermined width, e.g., ¼ inch, the switching mechanism will not be actuated, and voltage will not be applied to the voltage contact in the outlet. For the switch to close, two points on the neutral (or voltage) prong must have mechanical contact with the actuating mechanism.

Preferred forms of the invention, as well as other embodiments, objects, features and advantages of this invention, will be apparent from the following detailed description, which is to be read in connection with the accompanying drawings.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENTS

Figure 1:
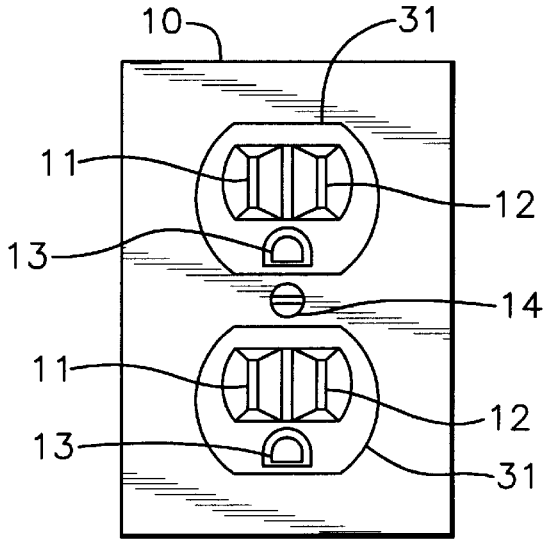
FIG. 1 is a plan view of a known common electrical wall outlet cover plate that may be used to cover the electrical safety outlet of the invention.
Figure 2A:
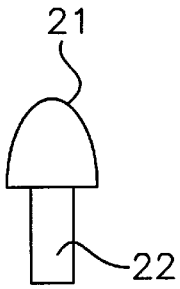
FIGS. 2(A–D) are elevation plan views of the four known common configurations for the neutral (return) prong of a polarized two-prong electrical plug.
Figure 2B:
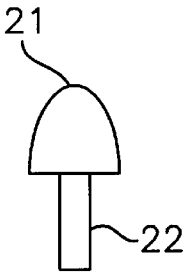
Figure 2C:
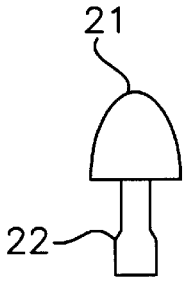
Figure 2D:
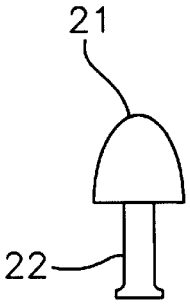

The present invention will be better understood from the specification taken in conjunction with the accompanying drawings in which like reference numerals refer to like parts.

Referring to the drawings in greater detail, and first to FIG. 1, the invention must be compatible with the common standard duplex wall electrical outlet top molding 31 if it is to gain wide acceptance. Wall electrical outlet top molding 31 has wider neutral slot 11 on the left side, when the cover plate half-rounded ground prong slot 13 is positioned below the slotted openings 11 and 12. Slot 11 must accept an electrical plug prong of about 5/16 inch wide. The narrower voltage (hot) slot 12 on the right side, when the cover plate half-rounded ground prong slot 13 is positioned below the slotted openings 11 and 12, must accept an electrical plug prong of about ¼ inch but not allow the wider neutral prong of about 5/16 inch to be inserted therein. Also shown is cover plate 10 and retaining screw 14.

Referring now to FIGS. 2(A–D) in greater detail. FIG. 2A shows a side elevation of a common polarized plug 20 having a plug body 21 and a neutral prong 22 extending from one end of said plug body 21. Said neutral prong 22 having a substantially rectangular shape with a width W of about 5/16 inch. FIG. 2B shows a side elevation of an older style common non-polarized plug 20 having a plug body 21 and a neutral prong 22 extending from one end of said plug body 21. Said neutral prong 22 having a substantially rectangular shape with a width W of about ¼ inch, the same as the width of the voltage prong 23 (not shown, see FIG. 7). FIG. 2C shows a side elevation of another style of common polarized plug 20 having a plug body 21 and a neutral prong 22 extending from one end of said plug body 21. Said neutral prong 22 having generally polygonal shape wherein a major portion of said neutral prong 22 has a width W of about ¼ inch and a portion distal from the plug body 21 has a width W of about 5/16 inch. FIG. 2D shows a side elevation of yet another common polarized plug 20 having a plug body 21 and a neutral prong 22 extending from one end of said plug body 21. Said neutral prong 22 having a width W of about ¼ inch over substantially all of its length and a minor distal portion (tip) having a width W of about 5/16 inch. It is to be understood that other prong shapes may be utilized within the scope of the present invention as long as they fit within the openings of the common duplex electrical outlet.

Figure 3:
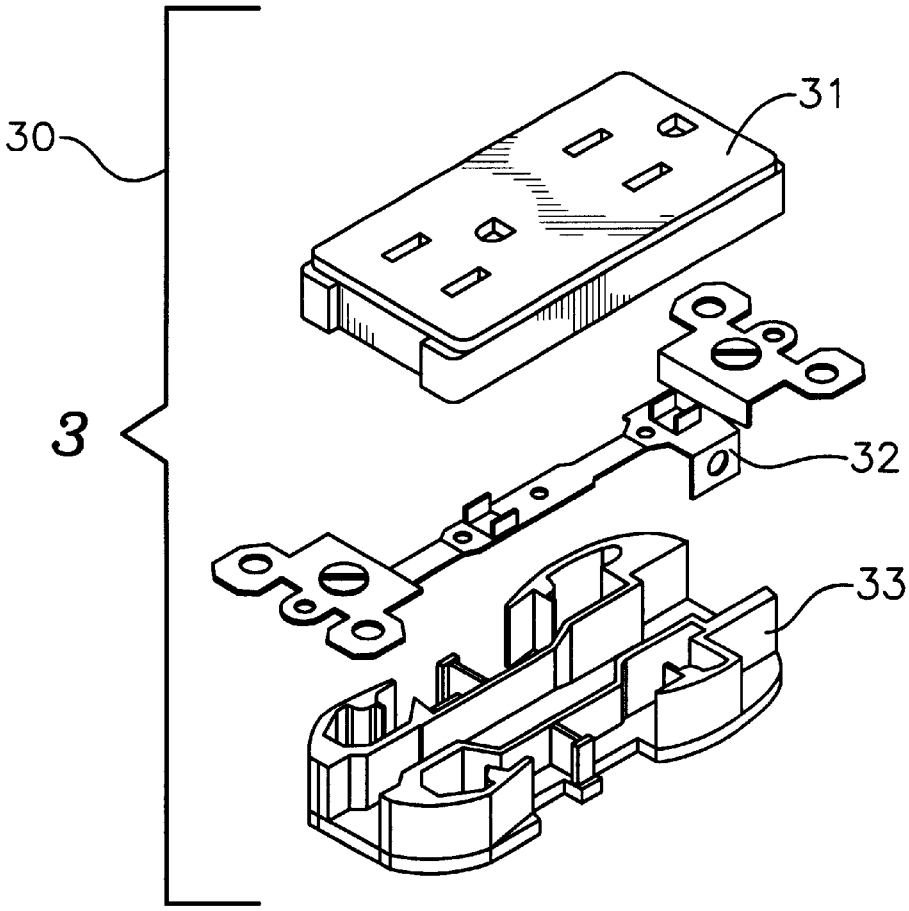
FIG. 3 is an exploded perspective view of a known typical electrical outlet minus the electrical contacts.

FIG. 3 is an exploded view of the commonly known duplex wall electrical outlet 30 having a front mating face (top) molding 31, a mounting bracket and half-rounded prong ground connection 32, and a back (bottom) molding 33. Another well known common form of duplex electrical wall outlet has the mounting bracket/ground connection 32 mounted on the bottom (outside face) of bottom molding 33 instead of between the top molding 31 and the bottom molding 33. It is understood that the invention also pertains to electrical wall outlets having more or less than two plug receptacles as well as those having both switches and plug receptacles. In addition, it is understood that the present invention may be utilized in ground fault interrupt (GFI) electrical outlets, power strips, surge protectors, uninterruptable power supplies and other devices having standard outlet(s). It can be adapted to 220 V outlets (e.g., range and drier) and other configurations.

Figure 4:
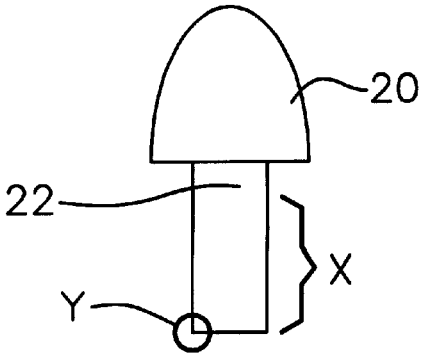
FIG. 4 is an elevation view of a typical mating plug showing the general areas of the neutral prong that must be sensed to turn on the switching mechanism.
Figure 5:
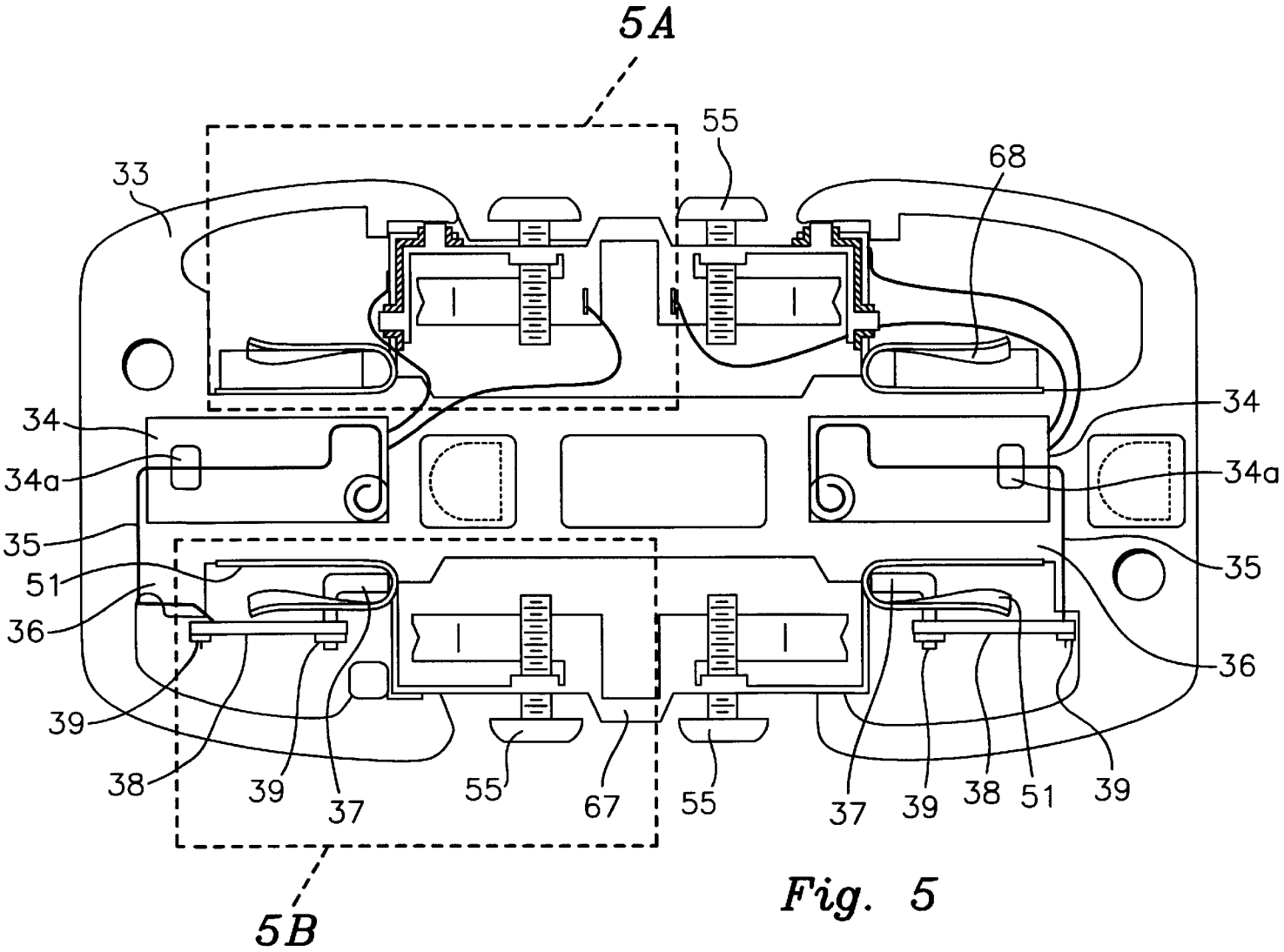
FIG. 5 is a top view showing one embodiment of the safety outlet of the present invention with top molding removed.
Figure 5A:
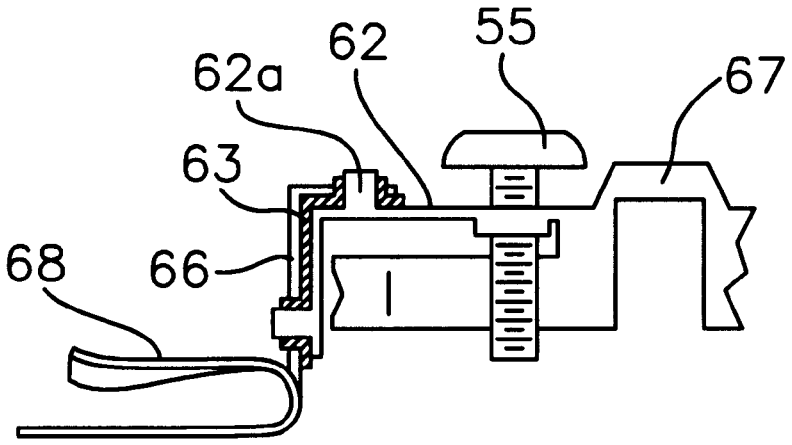
Figure 5B:
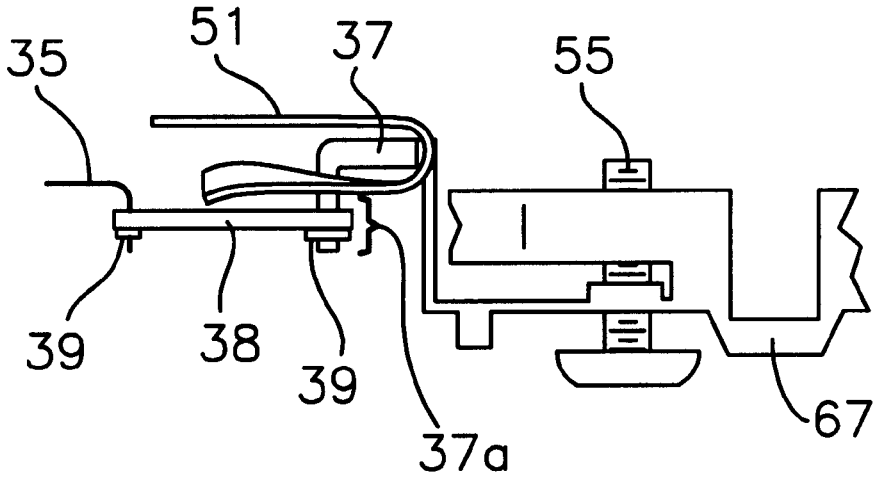

Referring now to FIG. 4, the neutral prong 22 must be at least ¼ inch wide to close the switching mechanism 34, as shown in FIG. 5. To achieve this objective, the safety outlet requires an enabling contact along one side of the neutral prong (FIG. 4, point X) and a second contact point at the opposite bottom corner (point Z). Actual points may be the two bottom corners, or one bottom corner and the opposite side. The sensing device for point X may contact the neutral prong either at the edge of the prong (bottom corner) as in the embodiment shown in FIGS. 4–6, or along the wide surface of the neutral prong as in the embodiment shown in FIGS. 7–9. If using the edge, the sensor must be designed so that no neutral prong of any shape will catch and be difficult to unplug.

Figure 6A:
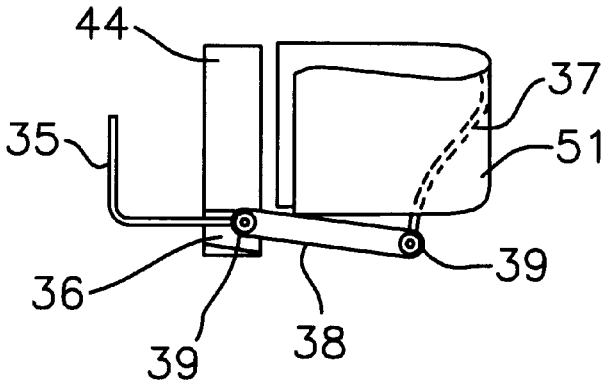
FIGS. 6(A–C) show the neutral contact with the sensing mechanism of FIG. 5.
Figure 6B:
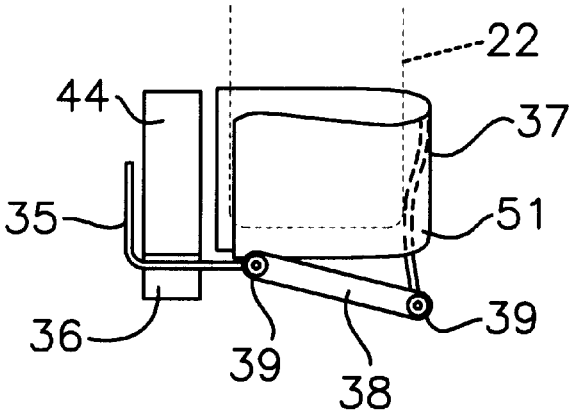
Figure 6C:
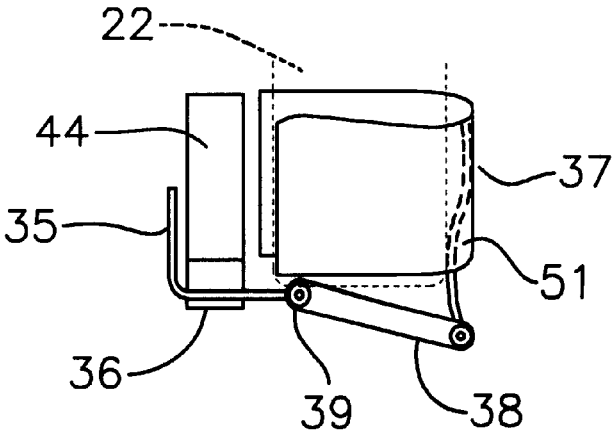

FIGS. 5 and 6 show the neutral contact 51 with spring/cam 37 passing down through one side of the contact. Spring/cam 37 is attached so that it is forced to one side as the neutral prong 22 of a plug is inserted. The lower part of spring/cam 37 has an extension 37*a* to one side that is completely outside the plane of neutral prong 22 or any other object inserted into the outlet. The outward extension 37*a* (Detail B) attaches via link 38 to one end of switch actuator spring/lever 35.

As a plug 20 is inserted, neutral prong 22 forces spring/cam 37 to move to one side of neutral contact 51. The link 38 attached to the extension on spring/cam 37 pulls spring/lever 35 under neutral plug prong 22. When the plug 20 is within a predetermined distance from being fully seated in outlet 30, spring/lever 35 is pressed downward by neutral prong 22. The upper portion of spring/lever 35 that passes over the actuator 34*a* of switch 34, energizing voltage contact 68. It should be understood that other configurations of spring actuators and switching mechanisms may be used on the neutral contact 51, the voltage contact 68, or both.

The bottom molding 33 has a ridge at the open end of neutral contact 51. Spring/lever 35 passes through a notch near the bottom of this ridge. When spring/cam 37 is pressed by neutral prong 22, link 38 pulls the end of spring/lever 35 under the neutral prong 22. Spring/lever 35 is pressed downward by the neutral prong 22, depressing switch actuator 34*a* and closing the switch 34. The ridge 36 at the end of neutral contact 51 prevents a small metal object, such as wire or paper clip, from being inserted at an angle and coming in contact with spring/lever 35, which action would apply power to the voltage contact 68. It will be understood spring/cam 37, link 38, and spring/lever 35 may be designed as a single piece for convenience of manufacture.

Figure 7:
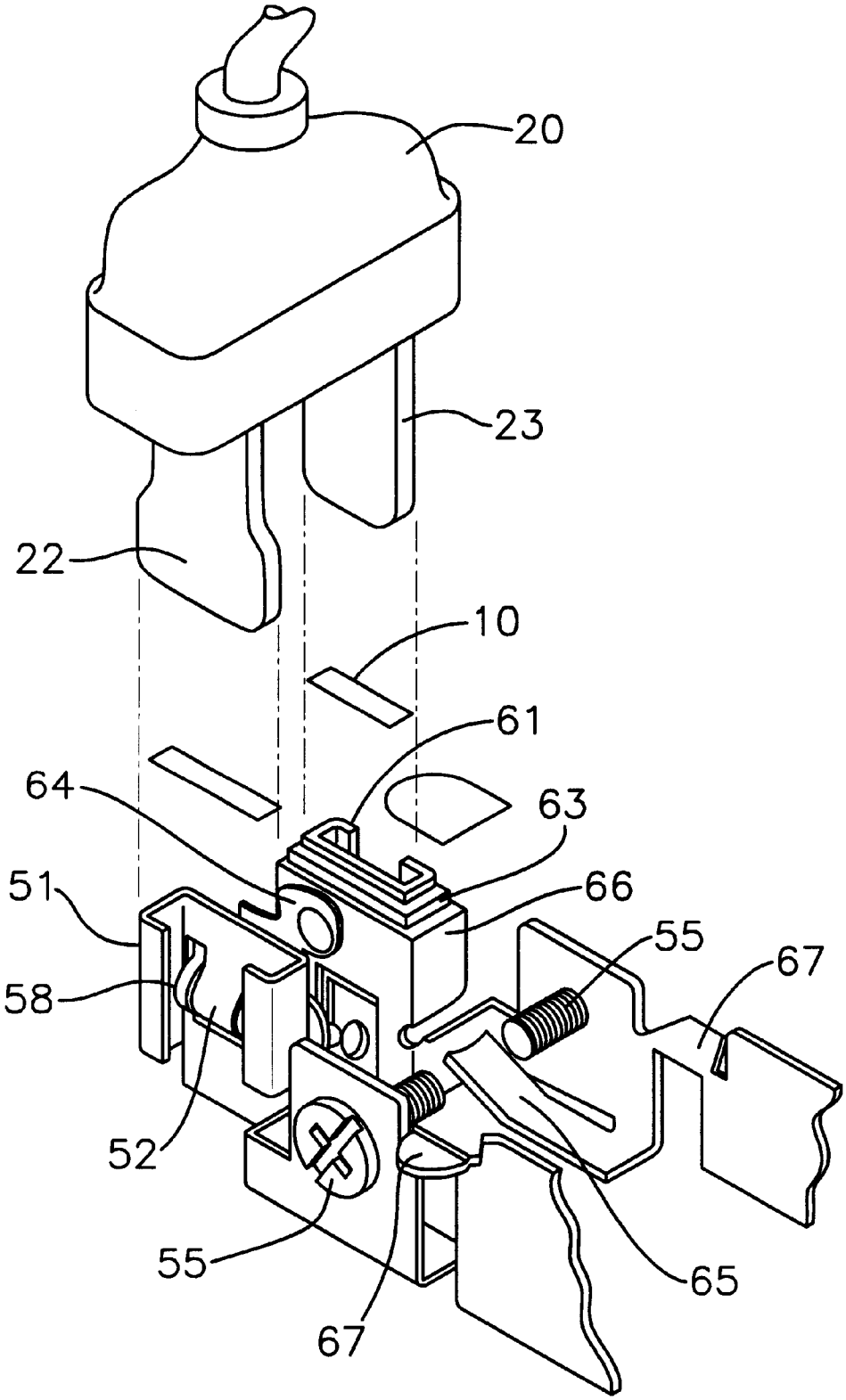
FIG. 7 is an exploded perspective view of a standard polarized two-prong electrical plug and the electrical safety contacts of another embodiment of the present invention.
Figure 8:
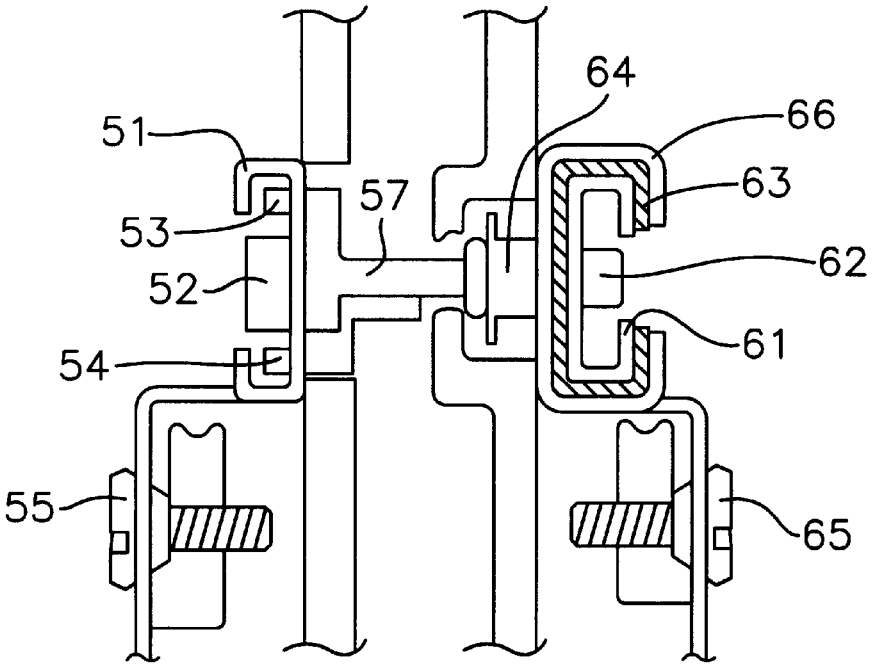
FIG. 8 is a top plan view of the electrical safety contact of the FIG. 7.
Figure 9A:
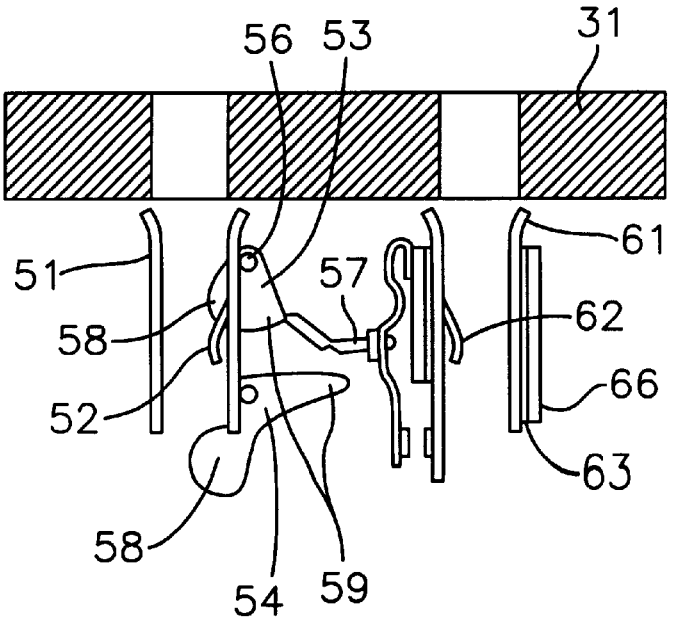
FIG. 9A is an elevation plan view of the electrical safety contacts of the present invention ready to receive a polarized two-prong electrical plug.

One embodiment of the present invention is fully disclosed in FIGS. 7, 8 and 9(A–C). More particularly referring now to FIG. 7 the invention is incorporated in an electrical outlet 30 comprising a neutral contact 51 and an inner voltage contact 61. Both contacts 51 and 61 have metal springs 52 and 62, respectively, to insure solid electrical contact between the contacts and the prongs of an electrical plug 20. The neutral contact 51 further comprising two cams 53 and 54, each having an exterior lobe 58 and an interior lobe 59, one cam mounted on either side of the metal spring 52, and located such that the neutral prong of an electrical plug at least ¼ inch wide will come in contact with the exterior lobes of both cams 53 and 54. Cam 53 being positioned near the opening in the neutral contact 51 and cam 54 being located below cam 53 and nearer the bottom of neutral contact 51. The cams 53 and 54 rotate on pivot pins 56 passing through cams 53 and 54 respectively and mounted in neutral contact 51. Cam 53 further has a hinged arm 57, attached to its interior lobe 59 which, extends toward and is attached to normally open spring switch 64. Both cams 53 and 54 are constructed of a non-conducting material, such as for example, plastic. The inner voltage contact 61 further comprising and outer voltage contact 66 electrically separated from inner voltage contact 61 by insulator 63. Outer voltage contact 66 further comprising wire connecting devices 55 and 65 (not shown, see FIG. 6) for connecting the electrical outlet 30 to an electricity supply wiring system. Insulator 63 allows for the mechanical joining of inner voltage contact 61 and outer voltage contact 66 while at the same time keeping them electrically isolated from one another. Metal spring 62, part of inner voltage contact 61, provides solid electrical contact with plug prong 22. Inner voltage contact 61 is electrically isolated from normally open spring switch 64.

Referring to FIG. 7 the present invention incorporated into an electrical outlet 30 is disclosed in a perspective view comprising electrical outlet 30, neutral contact 51, having exterior lobe 58 of cam 53 positioned to the side of metal spring 52. Also shown is part of normally open switch 64, outer voltage contact 66, insulator 63 and inner voltage contact 61. Further one type of preferred wire connecting devices 55 and 65 are disclosed as a combination slotted/phillips head screws. The position of top molding 31 is shown by the plug prong holes and a common polarized two-prong electrical plug 20 is positioned to show the manner of connecting an electrical device (not shown) to the electrical outlet 30 incorporating the present invention.

Referring now to FIG. 8 the present invention is further disclosed showing neutral contact 51, having cams 53 and 54 positioned on either side of spring 52. Hinged arm 57 of cam 53 is connected to normally open switch 64, in turn electrically connected to outer voltage contact 66 electrically isolated from inner voltage contact 61 by insulator 63. Wire connecting devices 55 and 65 are shown in one preferred form of the present invention as slotted screws.

In practice, before a common polarized two-prong or three-prong plug 20 is inserted into the electrical outlet incorporating the present invention (see FIG. 9A), spring 52 and exterior cam lobes 58 of cams 53 and 54 protrude into the channel of neutral contact 51. Likewise, spring 62 protrudes into the channel of voltage contact 61. Normally open switch 64 is in an electrically open orientation. In this configuration there is no electrical current applied to inner voltage contact 61. As a polarized two-prong or three-prong plug is inserted into the electrical outlet (see FIG. 9B) the voltage prong 23 depresses spring 62 thereby making solid contact with voltage contact 61. Likewise neutral prong 22 depresses spring 52 making solid contact with neutral contact 51 and also depresses the exterior lobe 58 of cam 53 thereby causing interior lobe 59 to bend hinged arm 57 downward toward the interior lobe 59 of cam 54. This action does not exert a force on switch 64 thereby maintaining switch 64 in a normally open position. As the plug 20 is pushed nearly fully into the electrical outlet 30 (see FIG. 9C) the neutral prong 22 of plug 20 depresses the exterior lobe 58 of cam 54 thereby causing interior lobe 59 of cam 54 to move upward against the hinged arm 57 straightening said hinged arm 57 causing it to exert a force against switch 64 thereby closing said switch 64 and completing the electrical circuit and allowing electrical energy to flow through the electrical outlet and into the polarized plug 20.

Figure 9B:
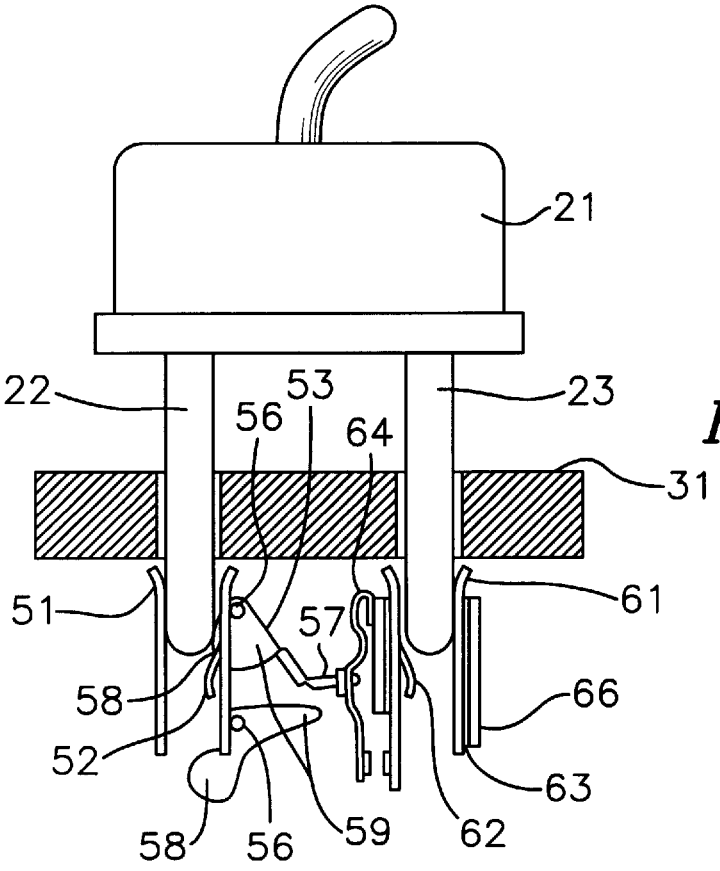
FIG. 9B is an elevation plan view of the electrical safety contacts of the present invention with a polarized two-prong electrical plug partially inserted therein.
Figure 9C:
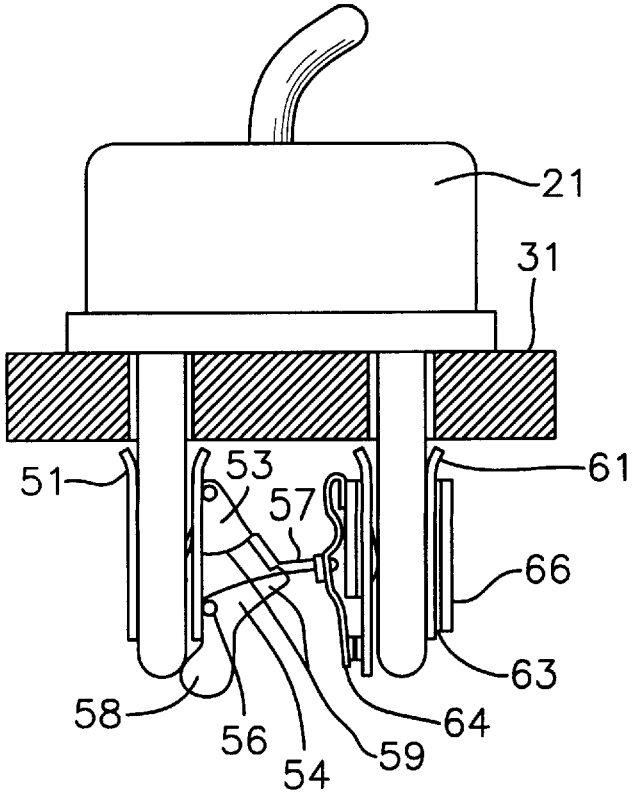
FIG. 9C is an elevation plan view of the electrical safety contacts of the present invention with a polarized two-prong electrical plug fully inserted therein.

As the polarized plug 20 is removed from the electrical outlet 30 the process is reversed and the electrical outlet 30 is returned to a safe electrically open circuit state as shown by FIG. 9B.

It is understood that hinged arm 57 is not fully straightened to prevent the possibility of the hinged arm 57 no relaxing and allowing switch 64 to return to its normally open position upon removal of upward force by interior lobe 59 of cam 54.

By positioning the cams 53 and 54 on opposite sides of spring 51 insertion of a foreign object such as a piece of wire, a paper clip, or a hairpin for example, will not be able to depress both exterior lobes 58 of both cam 53 and cam 54 simultaneously as is required to complete the electrical circuit and allow potentially harmful electrical current to flow through the electrical outlet 30. Thus the present invention provides for protection against the flow of electrical current until two prongs of proper width are inserted into the electrical outlet incorporating the present invention. The proper polarized plug must be inserted almost completely into the electrical outlet incorporating the present invention before electrical current is allowed to flow. Preferably, the cam 54 is positioned such that the neutral prong 22 of plug 20 is within about 1/16 inch of full insertion before exterior lobe 58 of cam 54 is fully depressed. This insures that the person inserting the plug will not be able to inadvertently cross both the neutral prong and voltage prong with his hand or finger and thereby expose himself to potentially harmful electrical current. In addition, any metal object, other than a polarized plug, wide enough and stout enough, to activate the electrical outlet incorporating the present invention will most likely be too stiff for a child to bend into a U shape and insert into both the neutral and voltage contacts thereby exposing the child to potentially harmful electrical current.

The material composition of the cams 53 and 54 and hinged arm 57 are not critical as long as the composition is not electrically conductive. That is the material must be an electrical insulator. A preferred material is a rigid plastic.

FIGS. 10(A–D) shows the bottom portion of the neutral side of the outlet. The position of the neutral prong 22 in the contact 51 is represented by a light colored line 69 inside the neutral contact. As the prong is inserted (FIG. 10B), spring/cam 37 is forced to one side, also sliding the latch block 40. When the neutral prong 22 presses down on lever 41, it pivots, raising the opposite end of the lever, which is attached to the switch actuator. If the object inserted into the neutral opening is less than ¼ inch wide, the spring/cam 37 may be pressed to the side, but the narrow object cannot simultaneously press down the lever at the opposite corner of the neutral prong. If the object is inserted at the lever end of the neutral prong opening, it contacts the lever, but cannot press it down because latch block 40 is under part of the lever 41, blocking its movement.

Figure 10A:
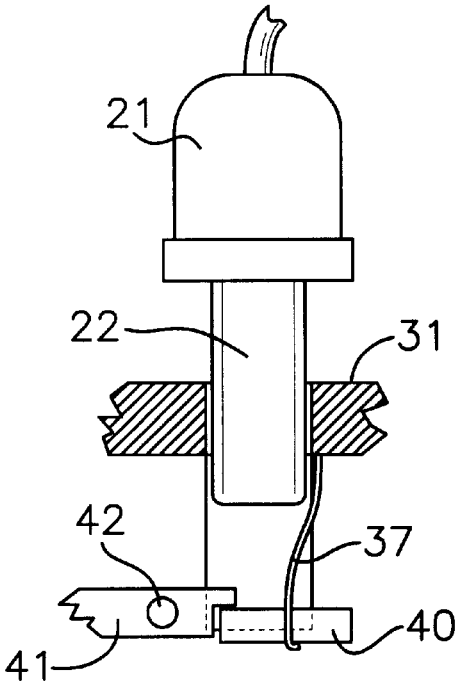
FIGS. 10(A–D) show sectional views of a neutral channel of an outlet of yet another embodiment of the present invention.
Figure 10B:
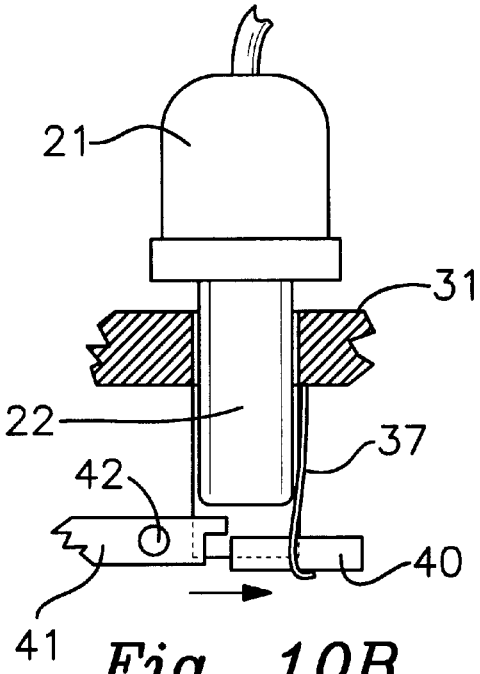
Figure 10C:
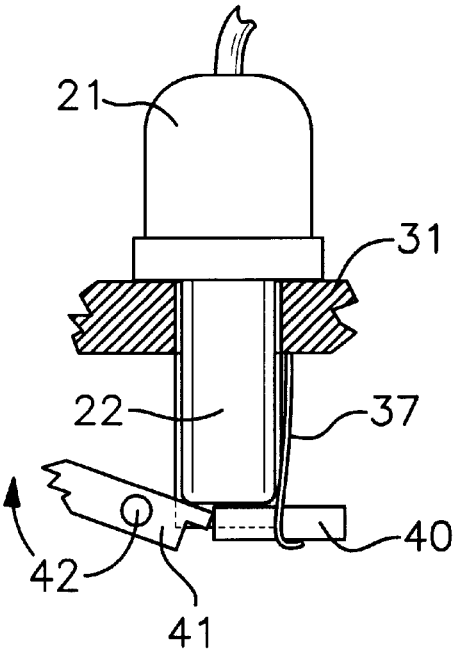
Figure 10D:
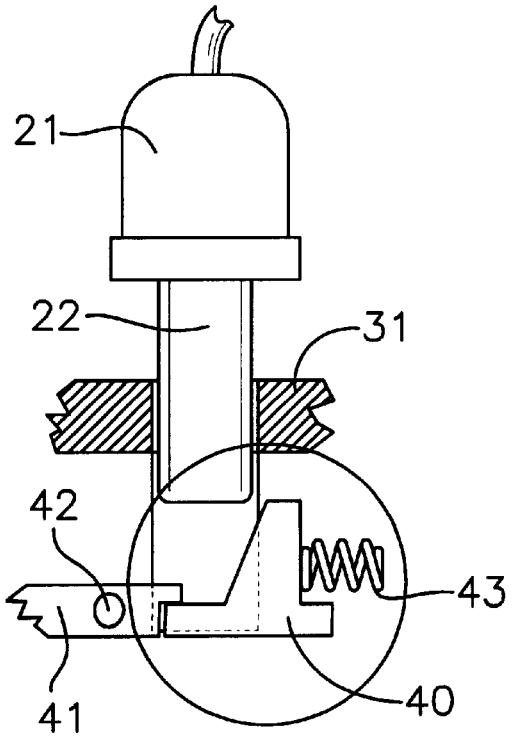

FIG. 10D shows the contact with the latch having a cam instead of a spring, thus combining the functions of spring/cam 37 and latch block 40.

It will be understood that the invention may be embodied in other specific forms without departing from the spirit or central characteristics thereof. For example, LED light sensors and electronic switches could be used in lieu of mechanical switches. The present examples and embodiments, therefore, are to be considered in all respects as illustrative and not restrictive, and the invention is not to be limited to the details given herein.

What is claimed is:

1. An electrical safety outlet comprising:

a) an electrical outlet plug receptacle of the type having top molding and having a neutral slot and having a voltage slot opening to said top molding thereof and receiving, in a mating direction, a neutral prong and a voltage prong, respectively, of a plug;

b) a normally opened switch assembly, electrically connected to the voltage contact slot;

c) a spring/cam assembly; said spring/cam assembly being in said neutral slot and having a sideways action as said neutral prong is inserted into said neutral slot;

d) a link;

e) a spring/lever connected to said spring/cam assembly by said link; said movement of said spring/cam assembly moves said spring/lever whereby when the plug is fully inserted, the neutral prong depresses the spring/lever, closing the normally opened switch assembly, thereby activating said electrical outlet receptacle to supply current to the plug;

f) said normally opened switch assembly being activated by said spring/cam assembly, said link and said spring/lever; said spring/cam assembly being physically located within said neutral slot and having an extension outside the plane of said neutral slot; said link attached to said spring/lever, thereby actuating said normally opened switch assembly, when said plug is inserted into said receptacle; the spring/cam assembly is pressed aside, moving said spring/lever by means of said link into the path of said neutral prong of said plug which upon full insertion depresses said spring/lever, closing said normally opened switch assembly and thereby, activating said outlet plug receptacle to supply current to said plug.

* * * * *